US007213406B2

(12) United States Patent
Decourioux et al.

(10) Patent No.: US 7,213,406 B2
(45) Date of Patent: May 8, 2007

(54) PIPE SUPPORT FOR COMPRESSOR SUBASSEMBLY

(75) Inventors: Gerard Decourioux, Amberieu en Bugey (FR); Xavier Girod, Montluel (FR); Jean De Bernardi, Lyons (FR)

(73) Assignee: Carrier Corporation, Farmington, CT (US)

( * ) Notice: Subject to any disclaimer, the term of this patent is extended or adjusted under 35 U.S.C. 154(b) by 57 days.

(21) Appl. No.: 10/801,754

(22) Filed: Mar. 15, 2004

(65) Prior Publication Data

US 2005/0201872 A1 Sep. 15, 2005

(51) Int. Cl.
*F25D 19/00* (2006.01)

(52) U.S. Cl. ..... 62/295

(58) Field of Classification Search ..... 62/295, 62/296, 297

See application file for complete search history.

(56) References Cited

U.S. PATENT DOCUMENTS

| | | | | | |
|---|---|---|---|---|---|
| 1,210,701 | A | * | 1/1917 | Ryden | 24/20 CW |
| 1,827,749 | A | * | 10/1931 | Horlacher | 62/295 |
| 1,870,228 | A | * | 8/1932 | Blood et al. | 62/295 |
| 2,136,097 | A | * | 11/1938 | Browne | 62/295 |
| 2,174,233 | A | * | 9/1939 | Body et al. | 62/295 |
| 2,234,742 | A | * | 3/1941 | Smith | 62/295 |
| 5,182,922 | A | * | 2/1993 | Allread et al. | 285/267 |

* cited by examiner

*Primary Examiner*—Michael Koczo, Jr.
(74) *Attorney, Agent, or Firm*—Bachman & LaPointe, P.C.

(57) ABSTRACT

A compressor assembly, including a compressor, at least one pipe having ends and an intermediate portion between the ends, the at least one pipe being connected to the compressor at the ends, and at least one support member for supporting the intermediate portion of the at least one pipe relative to the compressor.

6 Claims, 2 Drawing Sheets

PIPE SUPPORT FOR COMPRESSOR SUBASSEMBLY

BACKGROUND OF THE INVENTION

Compressors are widely used for various different needs, one of which is the heating, ventilation, air-conditioning and refrigeration industry. Such compressors involve the flow of refrigerant to various system components, and piping is frequently required to carry working fluids to various inlets and outlets of the compressor.

In operation, the compressor generates vibration, which is transmitted to the piping and can cause breakage. This vibration can be due to gas pulsations, direct vibration from the compressor, and the like.

The need exists for a solution to the vibration as described above. It therefore the primary object of the present invention to provide such a solution.

Other objects and advantages of the present invention will appear hereinbelow.

SUMMARY OF THE INVENTION

In accordance with the present invention, the foregoing objects and advantages have been readily attained.

According to the invention, a compressor assembly is provided which comprises: a compressor; at least one pipe having ends and an intermediate portion between the ends, the at least one pipe being connected to the compressor at the ends; and at least one support member for supporting the intermediate portion of the at least one pipe relative to the compressor.

The support member in accordance with the present invention can advantageously be utilized to support vertically-spaced pipes, and also can be utilized at different locations along the intermediate portions so as to greatly reduce the vibration experienced by these pipes and thereby reduce frequency of breakage of these pipes due to same.

BRIEF DESCRIPTION OF THE DRAWINGS

A detailed description of preferred embodiments of the present invention follows, with reference to the attached drawings, wherein.

DETAILED DESCRIPTION

The invention relates to compressor subassemblies and, more particularly, to a support member for a piping subassembly of a compressor which advantageously reduces vibration in the piping so as to avoid problems caused by same.

Figure 1:
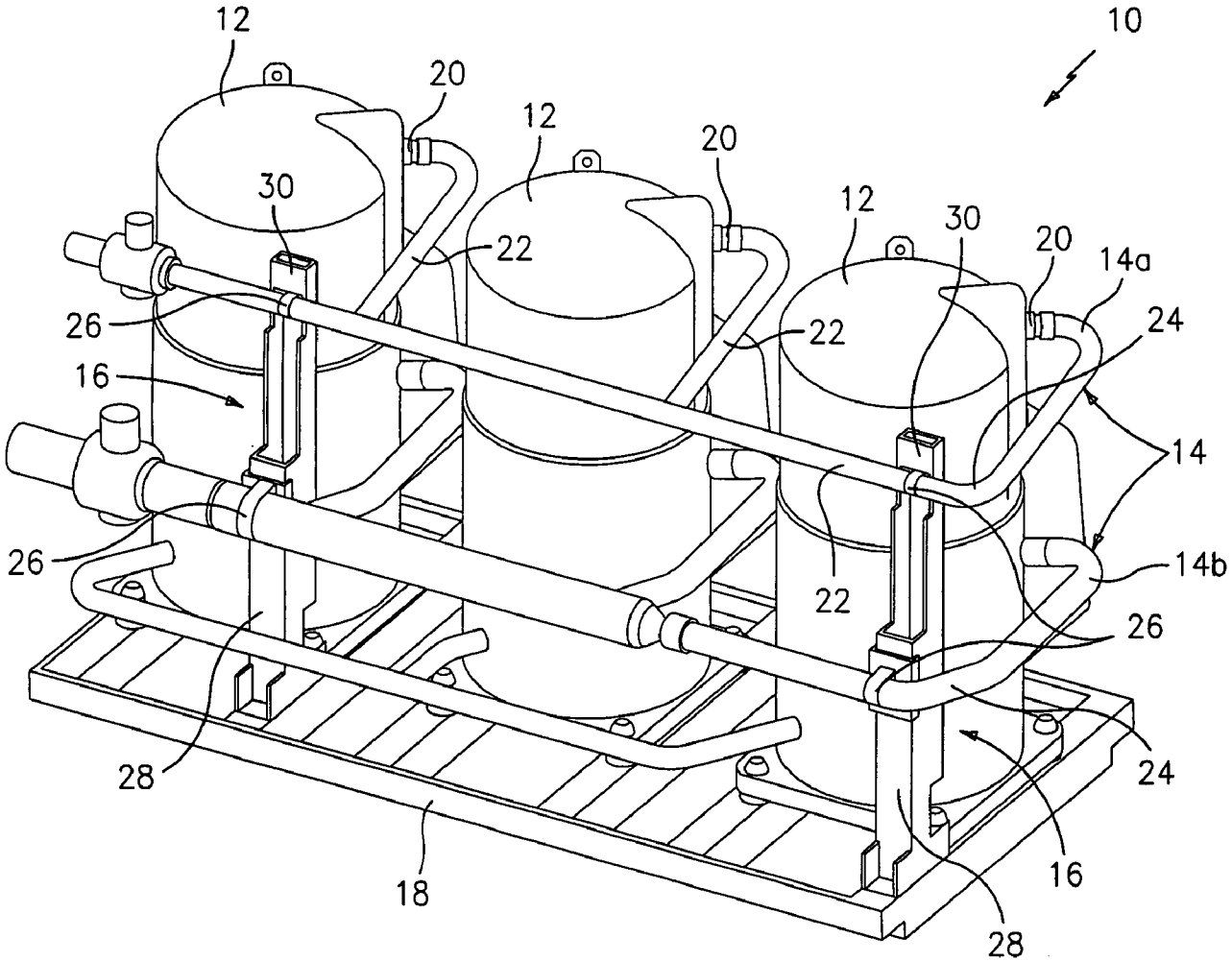
FIG. 1 schematically illustrates a compressor assembly in accordance with the present invention.

FIG. 1 shows a compressor assembly 10 including a plurality of compressors 12 having pipes 14 connected to same. As is well known to a person of ordinary skill in the art, pipes 14 are communicated with various inlets and outlets of compressors 12 for carrying refrigerant and/or other fluids during use of compressor 12 for the desired function.

As set forth above, compressors 12 generate vibration and gas pulsation through pipes 14, and such gas pulsation and vibration when transmitted to pipes 14 result in vibration of pipes 14, especially vibration or movement relative to compressor 12. This vibration leads to early failure of the pipes and the need for potentially expensive maintenance and repair.

In accordance with the present invention, support members 16 are provided for supporting pipes 14 relative to compressors 12 and, thereby, for advantageously reducing vibrations in the pipes 14.

According to the invention, compressors 12 advantageously have a base member 18, and in this case compressors 12 are mounted to base 18. Support members 16 can advantageously also be mounted to base 18 and also to piping 14.

In accordance with the present invention, pipes 14 have ends 20 where they are connected to compressors 12, and have intermediate portions 22 extending therebetween. It should be apparent from placement of the reference numerals that the intermediate portions are intended to include the entire expanse of pipe 14 extending between ends 20, and that pipes 14 are not necessarily a simple straight pipe.

In accordance with the present invention, support members 16 are advantageously mounted to base 18 and to intermediate portions 22 so as to support intermediate portions 22 relative to compressor 12 and thereby reduce vibration in pipes 14.

FIG. 1 shows an embodiment of the invention wherein two pipes 14 are supported, and these pipes are positioned substantially horizontally with respect to base 18, or substantially parallel thereto. These pipes 14 are also spaced vertically at a different distance from base 18, and are further typically spaced laterally a different distance from compressor 12.

In accordance with the invention, support members 16 can advantageously be positioned to be connected to both pipes 14. A plurality of supports, two (2) in the embodiment shown in FIG. 1, can also be provided and can advantageously be spaced along the length of intermediate portion 22. It should of course be appreciated that the exact location and number of supports to be used depends upon the configuration of pipe to be supported as well as the vibration expected to be caused by operation of compressor 12.

Figure 2:
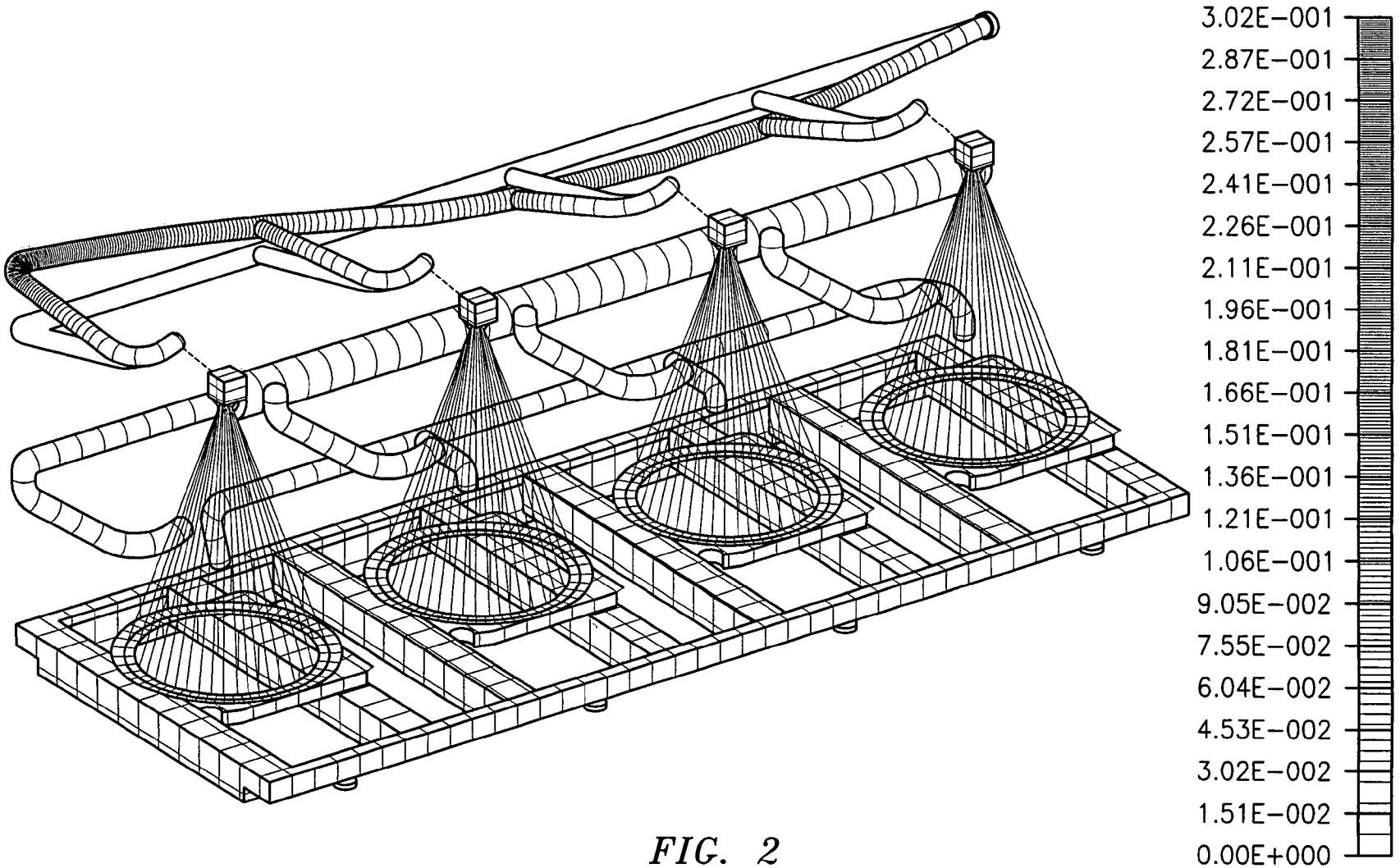
FIG. 2 illustrates the vibration experienced by a pipe without supports as compared to vibration experienced by a pipe with supports.

In order to demonstrate the effectiveness of the present invention, vibration was evaluated in a pipe of similar configuration to that shown in FIG. 1. with and without supports. FIG. 2 shows the vibration experienced as a function of location along the pipe. The vibration in the pipe without supports is quite large at some locations, and those locations are excellent positions for locating a support in accordance with the present invention. FIG. 2 also shows resulting frequency of vibration in a pipe which has been provided with supports in the two high-frequency vibration locations. FIG. 2 advantageously shows that the vibration has been substantially reduced.

In accordance with the invention, and referring back to FIG. 1, support members 16 can be secured relative to intermediate portion 22 of pipe 14 utilizing any suitable fastener. In the preferred embodiment, adjustable band fasteners 26 are utilized. These adjustable band fasteners are desirable since they can be utilized to secure support member 16 relative to pipes 14 having different diameters.

As mentioned above, a typical compressor assembly 10 will utilize pipes 14 of different size which are spaced vertically with respect to base 18. Further, these pipes can be spaced at different lateral distances from compressors 12. In the embodiment shown in FIG. 1, upper pipe 14*a* has a smaller diameter than lower piper 14*b*, and is positioned much closer to compressor 12 than pipe 14*b*. In this configuration, support 16 can advantageously be provided having a stepped surface facing pipes 14, for example as shown in FIG. 1, whereby one surface 28 is positioned for suitable connection to lower pipe 14*b* while a different surface 30, laterally spaced relative to surface 28, is properly positioned for securing relative to piping 14*a*. It should of course be appreciated that while FIG. 1 shows supports 16 connected to two pipes at different locations, pipe 16 can advantageously be utilized in different configuration as well, for example where three of more pipes are used and support 16 has three or more corresponding stepped surfaces.

It should also be appreciated that while FIG. 1 shows a preferred embodiment of the present invention wherein compressors 12 and supports 16 are both mounted to a base 18, other configurations are possible as well. For example, support 16 could be connected directly to compressor 12 and pipes 14, if desired. However, the configuration of FIG. 1 is particularly desirable since base 18 is a typical base for use with such components, and has a plurality of mounting surfaces or areas which are well suited toward mounting of support 16 as desired.

It should be readily be appreciated that the supports provided in accordance with the present invention can advantageously be used to reduce vibration in pipes as desired, thereby extending the useful life of compressor and pipe assemblies as desired.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed:

1. A compressor assembly, comprising:

a compressor;

at least one pipe having ends and an intermediate portion between the ends, the at least one pipe being connected to the compressor at the ends; and at least one support member for supporting the intermediate portion of the at least one pipe relative to the compressor, wherein the compressor has a base, and the at least one support member is connected to the base and the intermediate portion, wherein the at least one pipe is arranged with at least the intermediate portion substantially parallel to the base and spaced vertically relative to the base, wherein the at least one support member is connected to the intermediate portion of the at least one pipe, and further comprising at least one fastener for securing the intermediate portion to the at least one support member.

2. The assembly of claim 1, wherein the at least one support member comprises a plurality of support members connected to the intermediate portion at different locations.

3. The assembly of claim 1, wherein the fastener is an adjustable band fastener connected to the at least one support member whereby intermediate portions of different size can be supported.

4. A compressor assembly, comprising:

a compressor;

at least one pipe having ends and an intermediate portion between the ends, the at least one pipe being connected to the compressor at the ends; and at least one support member for supporting the intermediate portion of the at least one pipe relative to the compressor, wherein the compressor has a base, and the at least one support member is connected to the base and the intermediate portion, wherein the at least one pipe comprises a plurality of pipes arranged substantially parallel to the base and spaced vertically relative to the base, and wherein the at least one support member is connected to the intermediate portion of each of the plurality of pipes.

5. The assembly of claim 4, wherein the plurality of pipes are positioned at different distances from the compressor, and wherein the at least one support member has a pipe-facing surface which is stepped so as to correspond to the different distances.

6. A method for reducing vibration in pipes connected to compressors, comprising the steps of:

providing a compressor assembly having a compressor and at least one pipe each having ends and an intermediate portion extending between the ends, the at least one pipe being connected to the compressor at the ends; and positioning a support member connected to the intermediate portion for supporting the intermediate portion relative to the compressor whereby vibration in the at least one pipe is reduced, wherein the compressor has a base, and the at least one support member is connected to the base and the intermediate portion, wherein the at least one pipe is arranged with at least the intermediate portion substantially parallel to the base and spaced vertically relative to the base, and wherein the positioning step comprises connecting the at least one support member to the intermediate portion of the at least one pipe and to the base, and wherein the step of connecting the at least one support member to the intermediate portion comprises securing the intermediate portion to the at least one support member with at least one fastener.

* * * * *